US009611669B2

(12) United States Patent
Dawson

(10) Patent No.: US 9,611,669 B2
(45) Date of Patent: Apr. 4, 2017

(54) TENT STAKE

(71) Applicant: Ronald K. Dawson, Anza, CA (US)

(72) Inventor: Ronald K. Dawson, Anza, CA (US)

( * ) Notice: Subject to any disclaimer, the term of this patent is extended or adjusted under 35 U.S.C. 154(b) by 0 days.

(21) Appl. No.: 15/069,179

(22) Filed: Mar. 14, 2016

(65) Prior Publication Data

US 2017/0051527 A1 Feb. 23, 2017

Related U.S. Application Data

(60) Provisional application No. 62/207,480, filed on Aug. 20, 2015.

(51) Int. Cl.
*E04H 15/62* (2006.01)

(52) U.S. Cl.
CPC ..... *E04H 15/62* (2013.01)

(58) Field of Classification Search
CPC ..... E04H 15/62
USPC ..... 135/118
See application file for complete search history.

(56) References Cited

U.S. PATENT DOCUMENTS 1,555,322 A 9/1925 Kleinhesselink
1,805,084 A 5/1931 Gianini
3,431,924 A 3/1969 Simpson
3,456,660 A * 7/1969 Borchardt ..... E04H 15/62 135/118
3,758,062 A * 9/1973 Caldwell ..... E04F 21/05 135/118
3,788,336 A 1/1974 Steffes
4,261,424 A * 4/1981 Gonterman ..... B25D 1/04 173/91
4,263,925 A * 4/1981 Arganbright ..... B62D 33/08 135/118
4,432,382 A 2/1984 Wolf
4,593,872 A 6/1986 Svensson
4,905,718 A 3/1990 Vandiver
4,951,904 A 8/1990 Obenshain
5,040,924 A * 8/1991 Kothman ..... E02D 5/808 248/499
5,226,829 A * 7/1993 Jones ..... E04H 15/62 135/118
5,463,834 A * 11/1995 Krieger ..... E04H 15/62 135/118
5,699,864 A * 12/1997 Dvorak ..... E04H 12/2215 173/128
5,740,827 A * 4/1998 Swarringim ..... E04H 15/62 135/118
6,606,829 B2 * 8/2003 Benincasa ..... E02D 7/04 114/230.16

(Continued)

FOREIGN PATENT DOCUMENTS

FR 1201689 A * 1/1960 ..... E04H 15/62

*Primary Examiner* — David R Dunn
*Assistant Examiner* — Danielle Jackson
(74) *Attorney, Agent, or Firm* — Neustel Law Offices; Michael S. Neustel

(57) ABSTRACT

A tent stake that may be easily driven into and removed from various types of ground surfaces. The tent stake generally includes a shaft having a lower end portion and an upper end portion opposite of the lower end portion, a first connector attached to the upper end portion of the shaft and a second connector attached to the upper end portion of the shaft. The shaft is constructed of a rigid angle iron material to prevent bending or breakage during installation and removal.

20 Claims, 14 Drawing Sheets

(56) References Cited

U.S. PATENT DOCUMENTS

| | | | | |
|---|---|---|---|---|
| 6,758,456 | B2 * | 7/2004 | Krieger | E04H 15/62 248/156 |
| 7,082,954 | B1 | 8/2006 | Flanery | |
| 7,225,760 | B2 * | 6/2007 | Krieger | A01K 1/04 119/769 |
| 7,302,904 | B2 * | 12/2007 | Burns | E04H 15/62 114/294 |
| 8,118,047 | B2 * | 2/2012 | Simonson | E04H 15/62 135/118 |
| 8,479,757 | B2 * | 7/2013 | Zhou | E04H 15/62 135/118 |
| 8,656,651 | B1 * | 2/2014 | Scarano, Jr. | E04H 12/2223 52/157 |
| 9,428,933 | B2 * | 8/2016 | Simonson | E04H 15/62 |
| 2009/0277368 | A1 * | 11/2009 | Bulloch | B63B 21/40 114/230.2 |
| 2015/0225977 | A1 * | 8/2015 | Dawson | B66F 19/00 254/199 |

* cited by examiner

TENT STAKE

CROSS REFERENCE TO RELATED APPLICATIONS

I hereby claim benefit under Title 35, United States Code, Section 119(e) of U.S. provisional patent application Ser. No. 62/207,480 filed Aug. 20, 2015. The 62/207,480 application is hereby incorporated by reference into this application.

STATEMENT REGARDING FEDERALLY SPONSORED RESEARCH OR DEVELOPMENT

Not applicable to this application.

BACKGROUND

Field

Example embodiments in general relate to a tent stake that may be easily driven into and removed from various types of ground surfaces.

Related Art

Any discussion of the related art throughout the specification should in no way be considered as an admission that such related art is widely known or forms part of common general knowledge in the field.

Tent stakes are used to secure various types of structures such as, but not limited to, tents, sun shades, tarps and the like. Conventional tent stakes are constructed of lower quality materials (e.g. plastic material or lightweight metal) making them susceptible to damage during installation and/or removal. Conventional tent stakes are also difficult to drive into or remove from harder ground surfaces without damaging the conventional tent stakes. During removal of conventional tent stakes, when the tent stake breaks off exposing a portion above the ground surface this creates a hazard for others walking in the area and also creates an environmental hazard because the stake is left to rot in the ground.

SUMMARY

An example embodiment of the present invention is directed to a tent stake. The tent stake includes a shaft having a lower end portion and an upper end portion opposite of the lower end portion, a first connector attached to the upper end portion of the shaft and a second connector attached to the upper end portion of the shaft. The shaft is constructed of a rigid angle iron material to prevent bending or breakage during installation and removal.

There has thus been outlined, rather broadly, some of the features of the tent stake in order that the detailed description thereof may be better understood, and in order that the present contribution to the art may be better appreciated. There are additional features of the tent stake that will be described hereinafter and that will form the subject matter of the claims appended hereto. In this respect, before explaining at least one embodiment of the tent stake in detail, it is to be understood that the tent stake is not limited in its application to the details of construction or to the arrangements of the components set forth in the following description or illustrated in the drawings. The tent stake is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
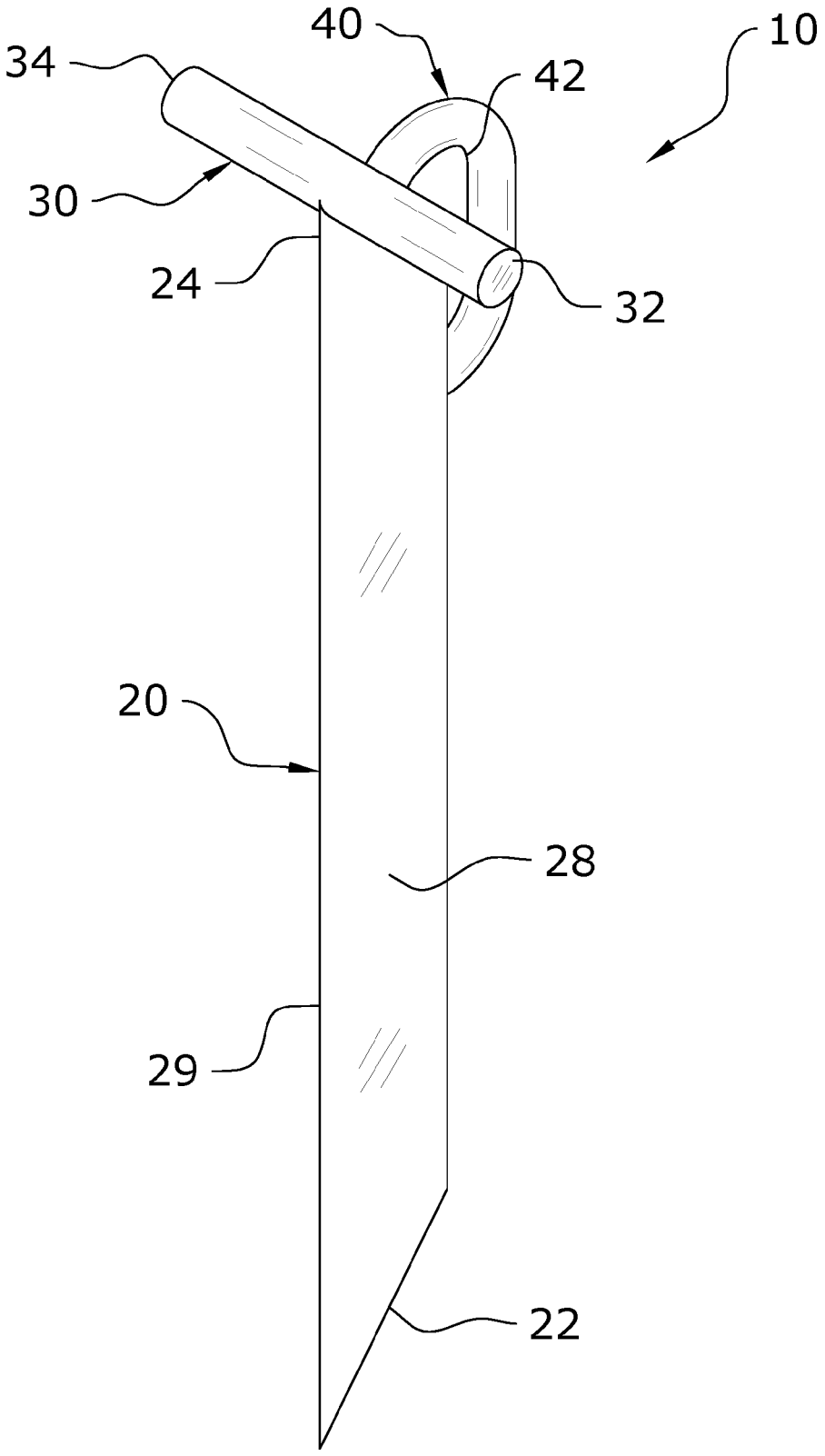
FIG. 1 is a front perspective view of a tent stake in accordance with an example embodiment.
Figure 2:
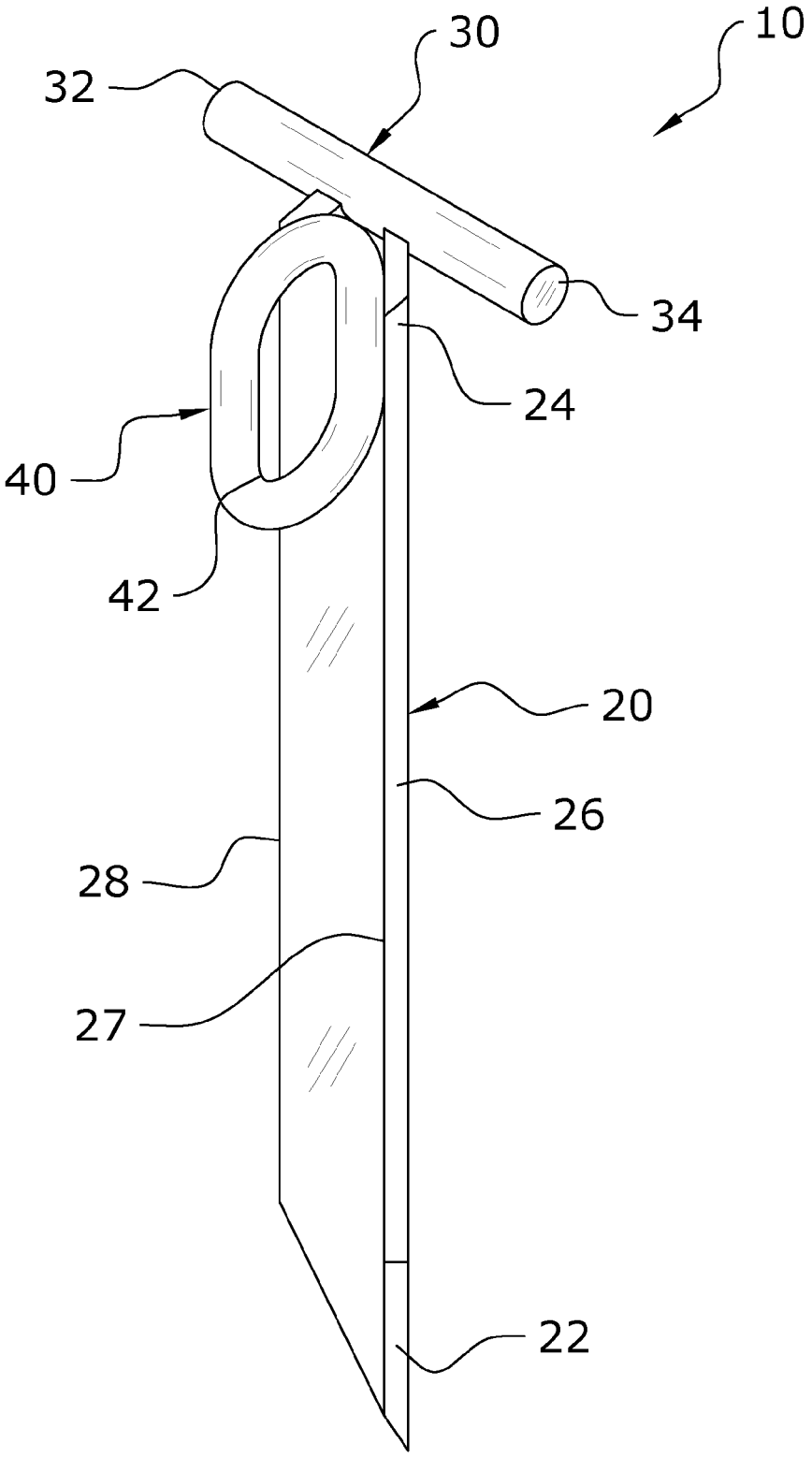
FIG. 2 is a rear perspective view of a tent stake in accordance with an example embodiment.

A. Overview.

An example tent stake 10 generally comprises a shaft 20 having a lower end portion 22 and an upper end portion 24 opposite of the lower end portion 22, a first connector 30 attached to the upper end portion 24 of the shaft 20 and a second connector 40 attached to the upper end portion 24 of the shaft 20. The shaft 20 is constructed of a rigid angle iron material to prevent bending or breakage during installation and removal. While the first connector 30 and the second connector 40 are illustrated as a cross member and a loop respectively as one embodiment of the present invention, the present invention is not limited to the embodiment illustrated in the figures or the specific connectors illustrated in the figures.

B. Shaft.

The shaft 20 has a lower end portion 22 and an upper end portion 24 opposite of the lower end portion 22 as illustrated in FIGS. 1 through 6 of the drawings. The shaft 20 is constructed of a rigid metal material (e.g. steel). The shaft 20 is also preferably a substantially straight structure to allow for the shaft 20 to be driven into the ground surface 19 efficiently. The length of the shaft 20 is preferably approximately 12.5 inches, however, greater or less lengths may be used for the shaft 20.

FIGS. 1 through 8 illustrate the shaft 20 being constructed of a length of angle iron wherein the lower end portion 22 of the angle iron is tapered to a pointed end. The lower end of the shaft 20 is preferably sharpened to a point to easily penetrate the ground surface 19. The shaft 20 is preferably comprised of a first portion 26 and a second portion 28 as illustrated in FIGS. 1 through 8 of the drawings. The first portion 26 and the second portion 28 are each preferably flat in structure and at an acute angle with respect to one another.

Figure 8:
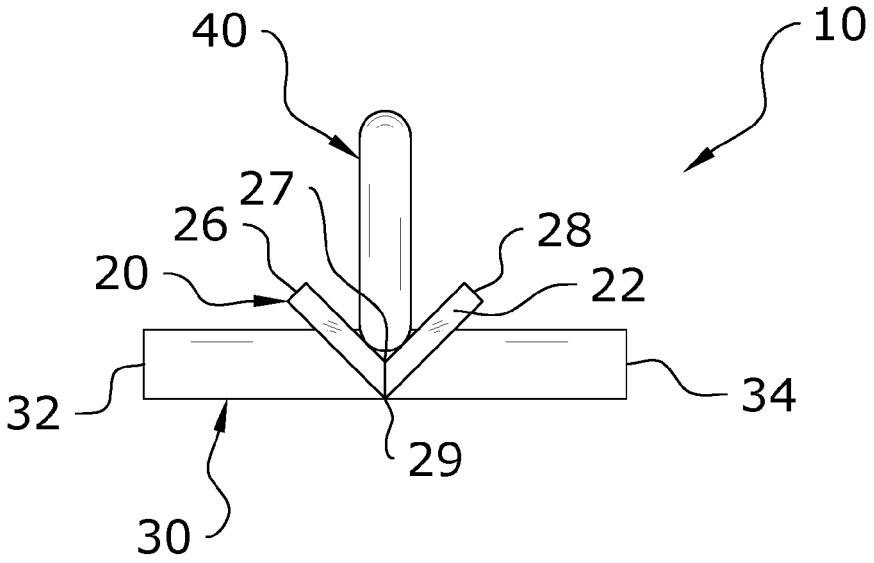
FIG. 8 is a bottom view of the tent stake.
Figure 14:
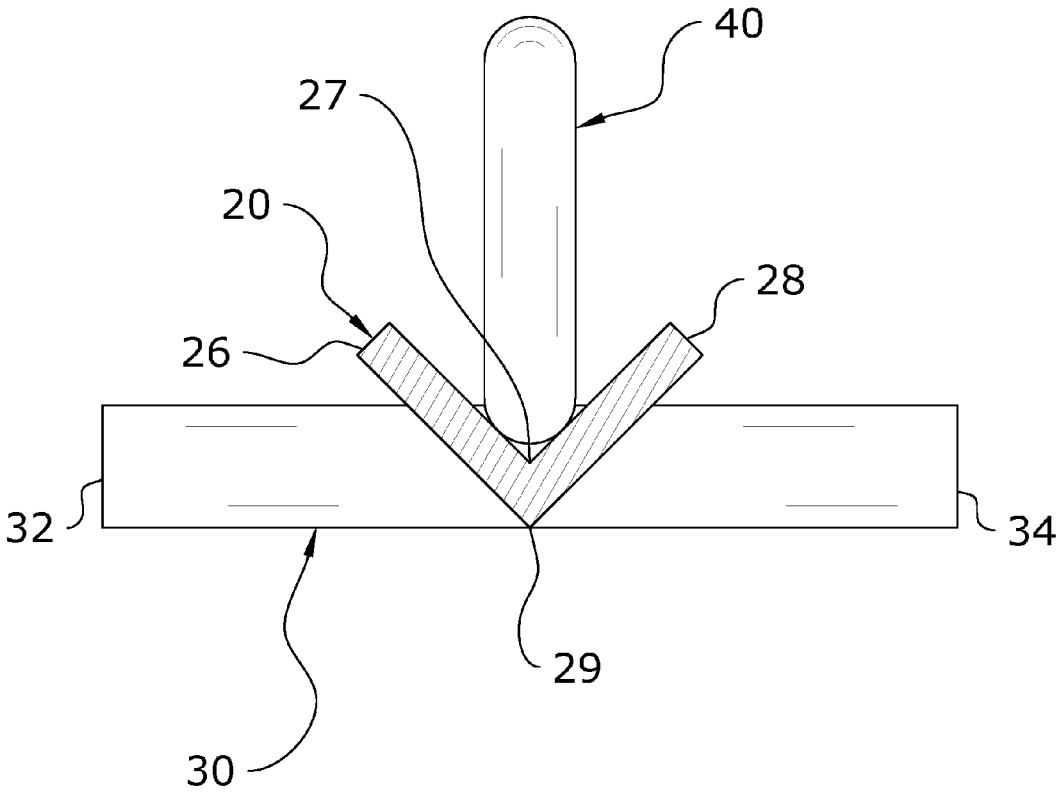
FIG. 14 is a cross sectional view taken along line 14-14 of FIG. 3.

The first portion 26 and the second portion 28 both extend longitudinally and have an inner angle between thereof forming a front ridge 29 and a rear inner corner 27 that extend longitudinally along the shaft 20. The thickness of the first portion 26 and the second portion 28 is preferably the same and at least sufficient in strength to avoid bending during hammering by a driving tool 12 (e.g. hammer, sledgehammer). The first portion 26 and the second portion 28 form a V-shaped cross section shape as best illustrated in FIGS. 8 and 14 of the drawings. The shaft 20 is preferably comprised of 1"×1"×3/16" angle iron, however, greater or smaller types of angle iron may be used.

The inner angle between the first portion 26 and the second portion 28 is preferably approximately ninety-degrees defining the rear inner corner 27 opposite of the front ridge 29 as illustrated in FIGS. 2, 4, 8 and 14 of the drawings. However, the inner angle may be greater or less than ninety-degrees depending upon the application.

C. First Connector.

The first connector 30 is attached to the upper end portion 24 of the shaft 20. The first connector 30 may be attached to the upper end of the upper end portion 24 or to the side of the upper end portion 24 of the shaft 20. The first connector 30 is preferably comprised of an elongated structure that extends transversely with respect to the stake as illustrated in FIGS. 1 through 8 of the drawings. However, various other connectors may be used for the first connector 30 that are adapted for connecting to with a flexible connector 14 and/or a connecting link 16.

The first connector 30 is adapted for both connecting to with a flexible connector 14 and/or connecting link 16 along and for being striked by a driving tool 12 (e.g. hammer, sledgehammer) to drive the shaft 20 into the ground. The first connector 30 provides a broader striking area for the driving tool 12 and prevents damage to the shaft 20 by distributing the striking forces throughout the upper end portion 24 of the shaft 20.

The first connector 30 is preferably comprised of metal and is welded to the upper end portion 24 of the shaft 20. However, the first connector 30 may be fastened to the shaft 20 via various other fasteners (e.g. bolts). The first connector 30 preferably forms a cleat structure for receiving an elongated flexible connector 14 (or a connecting link 16 attached to the distal end of a flexible connector 14), such as, but not limited to, a rope, a cable, string, chain, elastic bands and the like.

Figure 3:
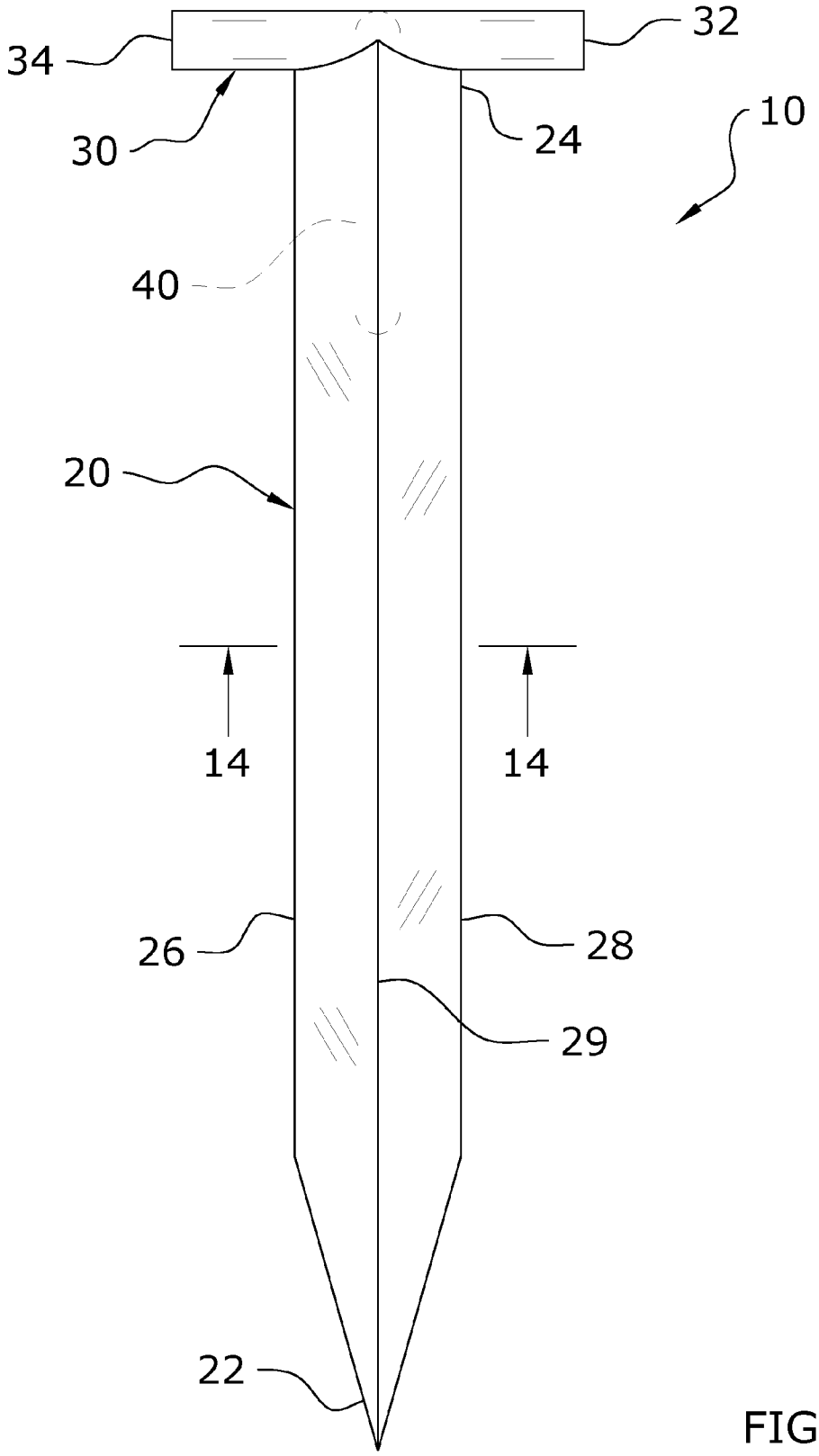
FIG. 3 is a front view of the tent stake.
Figure 4:
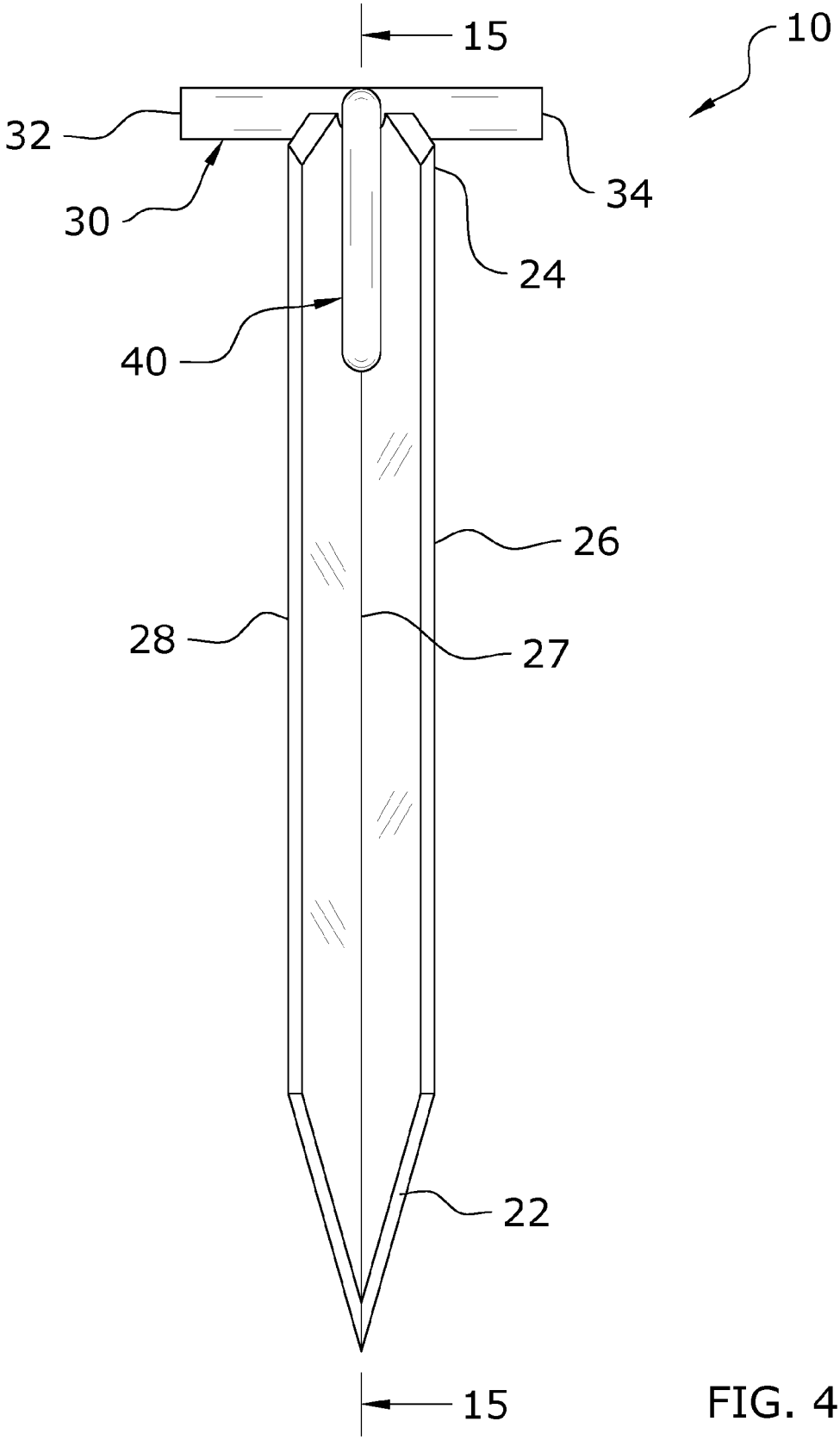
FIG. 4 is a rear view of the tent stake.
Figure 5:
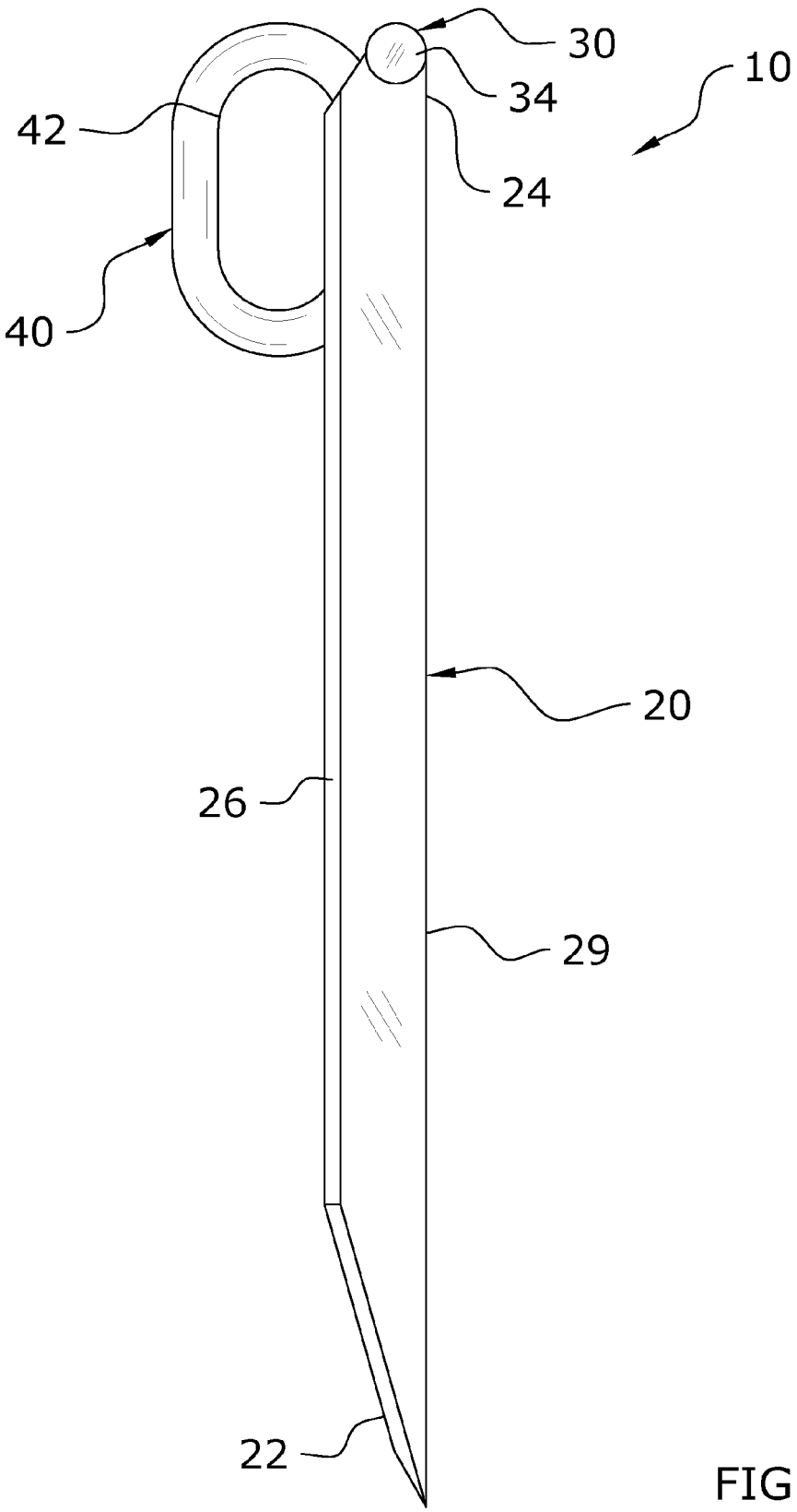
FIG. 5 is a first side view of the tent stake.
Figure 6:
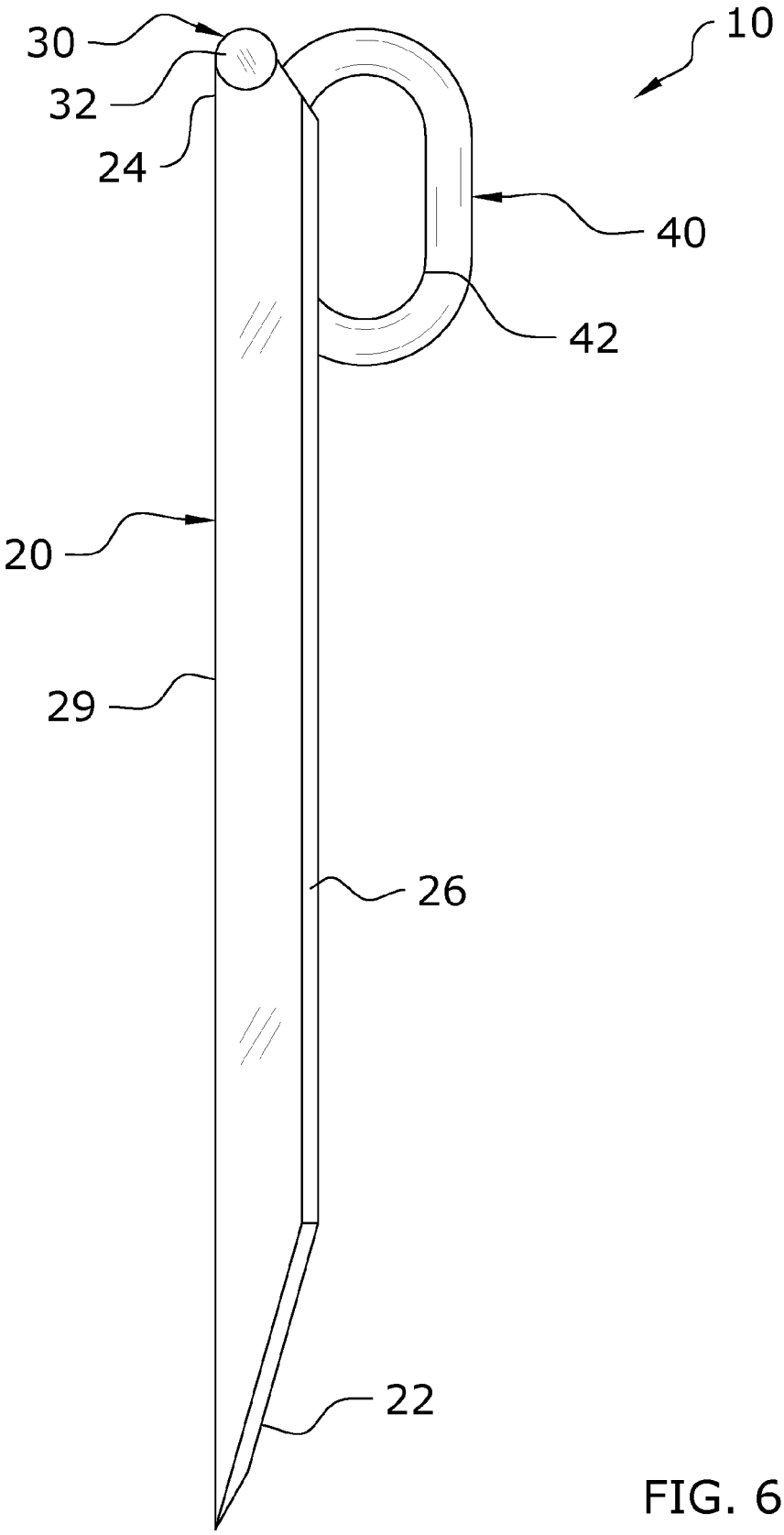
FIG. 6 is a second side view of the tent stake.

The first connector 30 preferably has a first extended portion 32 extending from a first side of the stake and a second extended portion 34 extending from a second side of the stake opposite of the first extended portion 32 thereby forming a T-shaped structure with the shaft 20 as best illustrated in FIGS. 3 and 4 of the drawings. The first connector 30 may extend above the upper end of the shaft 20 as shown in FIG. 4. The first extended portion 32 and the second extended portion 34 preferably have approximately the same length. The first connector 30 is preferably a length of a metal shaft 20 having a cylindrical shape, however, various other structures may be used. It is preferable that the first connector 30 is comprised of a metal rod that is approximately 3.5 inches in length with a diameter of approximately 0.5 inches.

D. Second Connector.

The second connector 40 is also attached to the upper end portion 24 of the shaft 20. The second connector 40 may be attached to the front, rear or upper end of the shaft 20 similar to the first connector 30. However, it is preferable that the second connector 40 is attached to the rear inner corner 27 of the stake as illustrated in FIGS. 2, 4, 8, 14 and 15 of the drawings.

Figure 15:
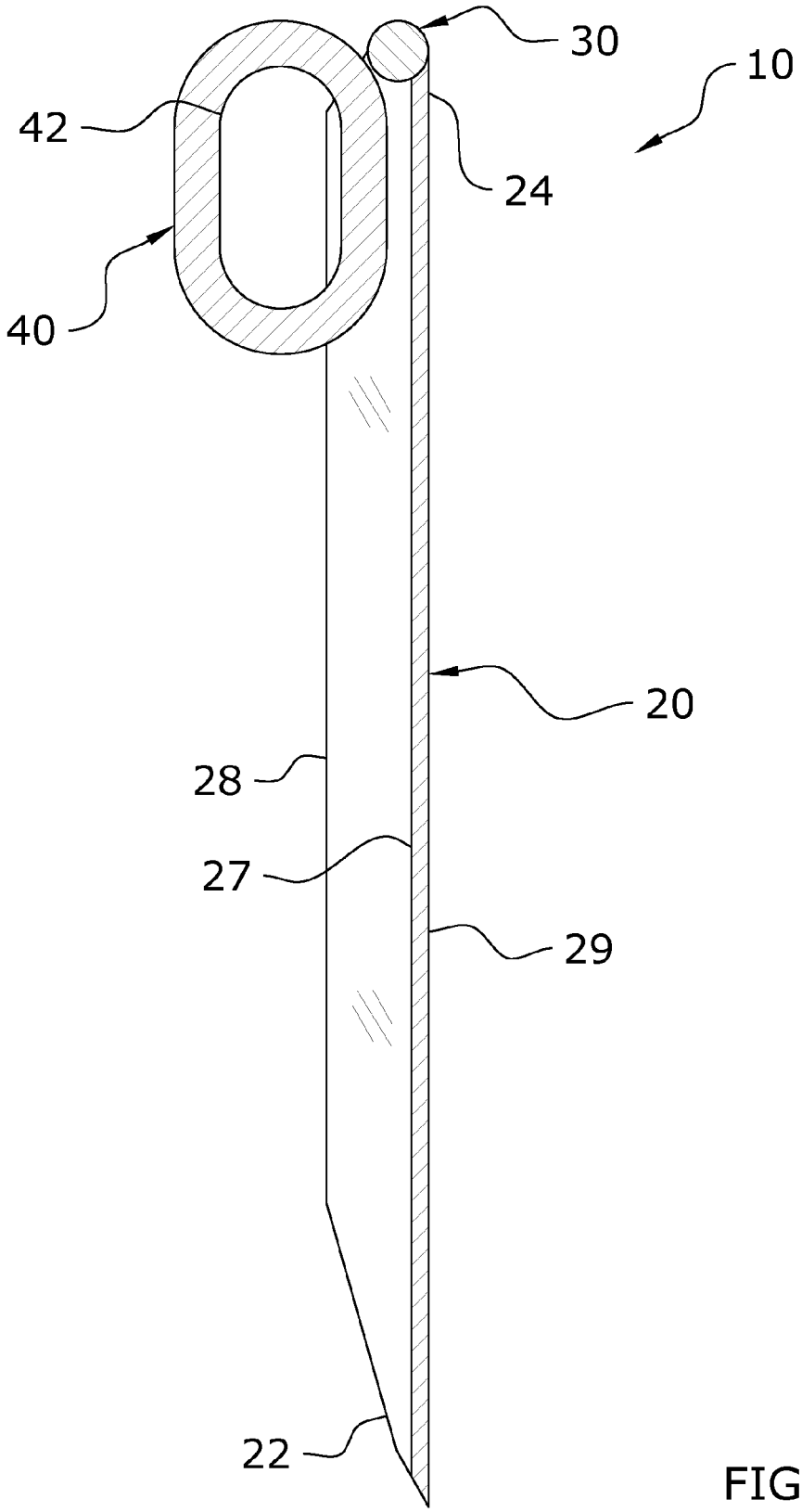
FIG. 15 is a cross sectional view taken along line 15-15 of FIG. 4.

The second connector 40 is preferably comprised of a loop structure having an opening 42 that a connecting link 16 (e.g. carabiner, hook) and/or a flexible connector 14 (e.g. rope, cable, chain) may be removably connected to. The loop structure is preferably elongated forming an elongated oval shaped opening 42 as best illustrated in FIG. 15 of the drawings. The inner edge of the second connector 40 is attached to the rear inner corner 27 of the stake by welding or fasteners. The second connector 40 is preferably comprised of a 5/16 inch metal chain link welded to the stake. However, the second connector 40 may be comprised of a non-loop structure such as, but not limited to, a hook or an eyelet within the body of the shaft 20.

Figure 7:
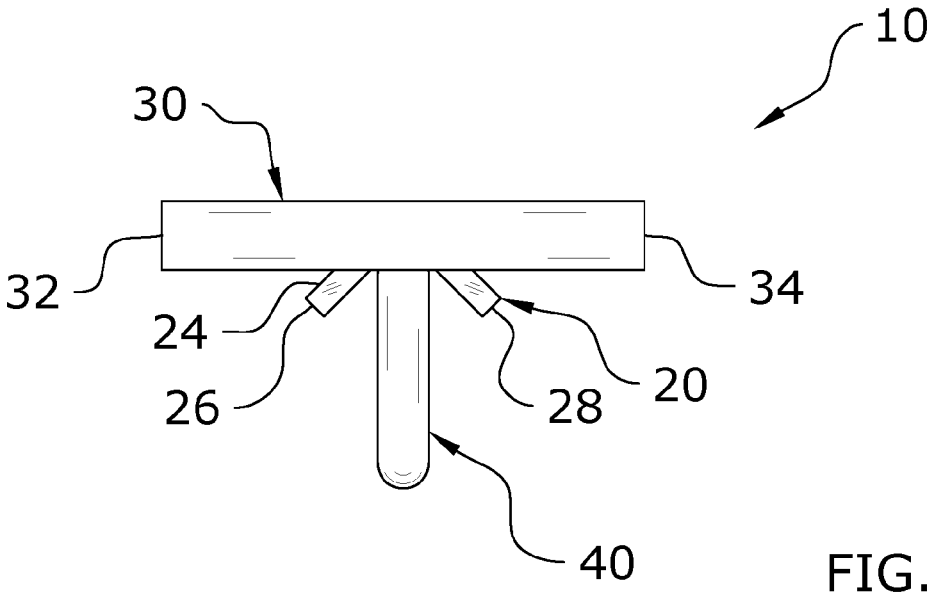
FIG. 7 is a top view of the tent stake.

The loop structure preferably extends rearwardly from a rear inner corner 27 of the stake and further extends outwardly past a rear edge of the stake. The first connector 30 and the second connector 40 form a T-shaped structure when viewed from the top as illustrated in FIG. 7 of the drawings. The upper end of the first connector 30 and the upper end of the second connector 40 are on or near a common plane to provide a relatively flat striking surface for the head of the driving tool 12.

E. Operation of Preferred Embodiment.

Figure 10:
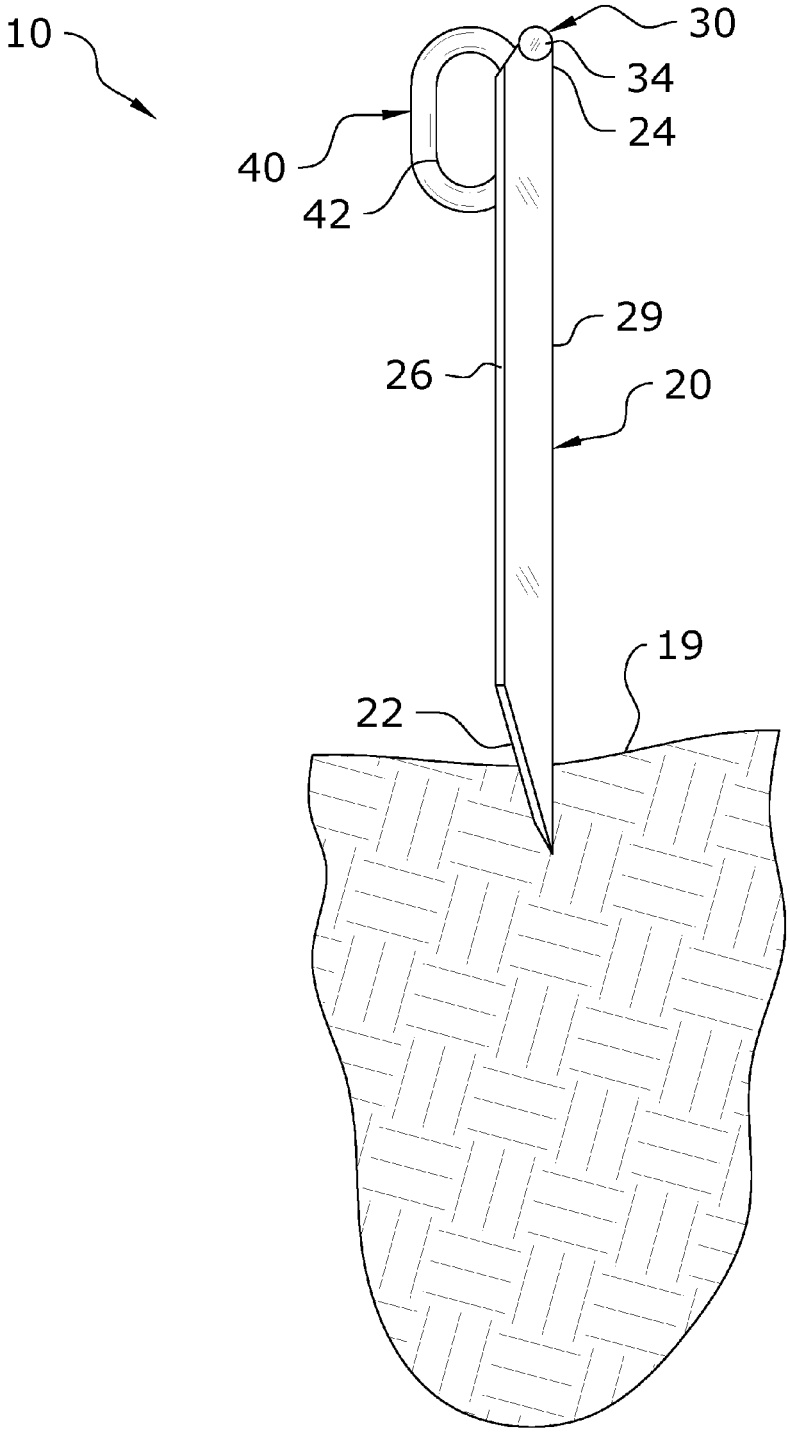
FIG. 10 is a side view illustrating the tent stake prior to being driven into the ground surface.
Figure 11:
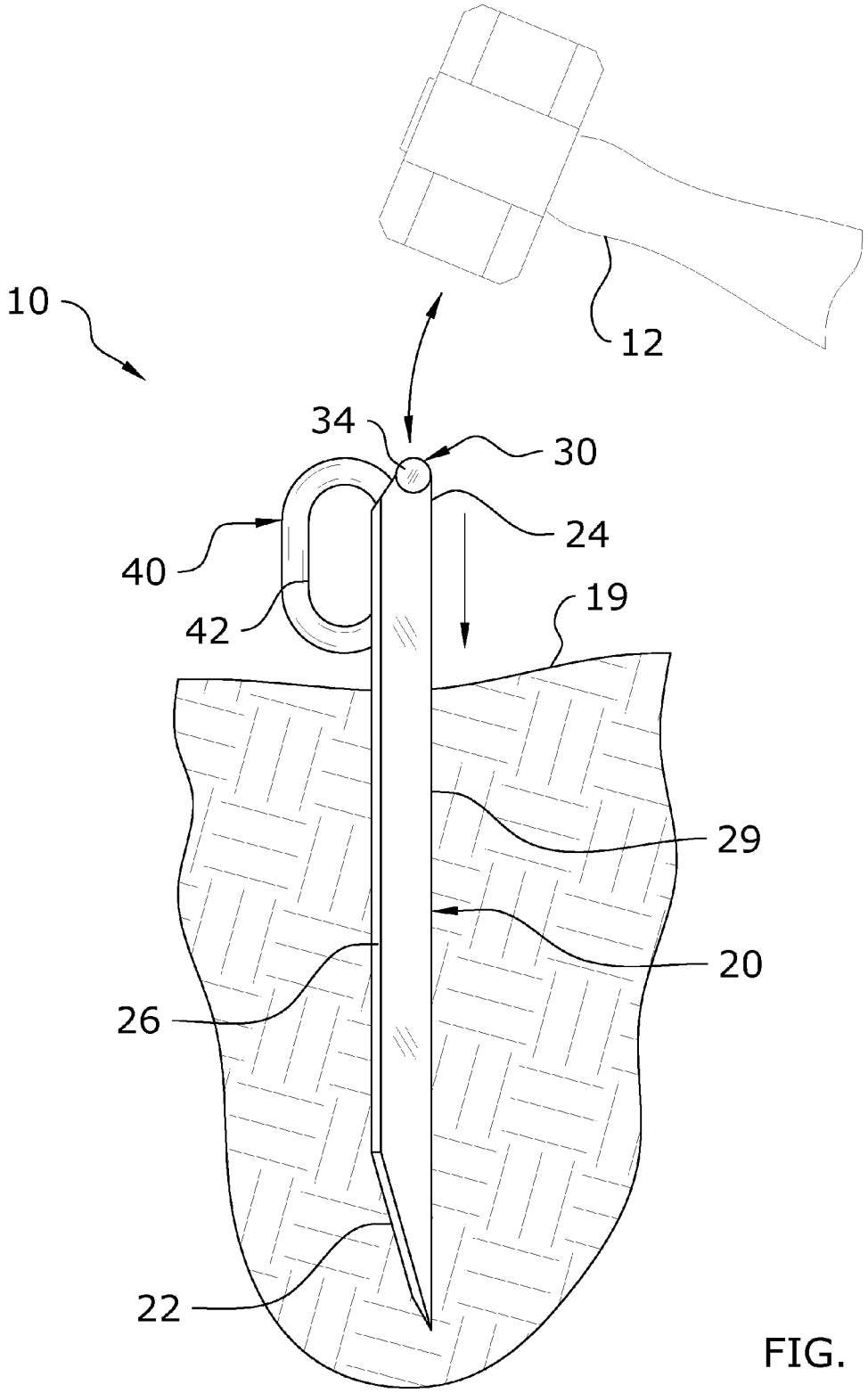
FIG. 11 is a side view illustrating the tent stake being driven into the ground surface.

In use, the user identifies a location to penetrate the ground surface 19 with the tent stake 10. The user positioned the lower pointed end of the shaft 20 on the ground surface 19 as shown in FIG. 10 and then strikes the upper end of the tent stake 10 repeatedly thereby driving the shaft 20 into the ground surface 19 as shown in FIG. 11. When striking the upper portion of the tent stake 10, the driving tool 12 preferably engages at least the first connector 30 and/or the second connector 40 to drive the shaft 20 into the ground surface 19. The shaft 20 is driven approximately 10 inches into the ground surface 19 leaving approximately 2 inches of the shaft 20 above the ground surface 19 as illustrated in FIGS. 11 through 13 of the drawings.

Figure 9:
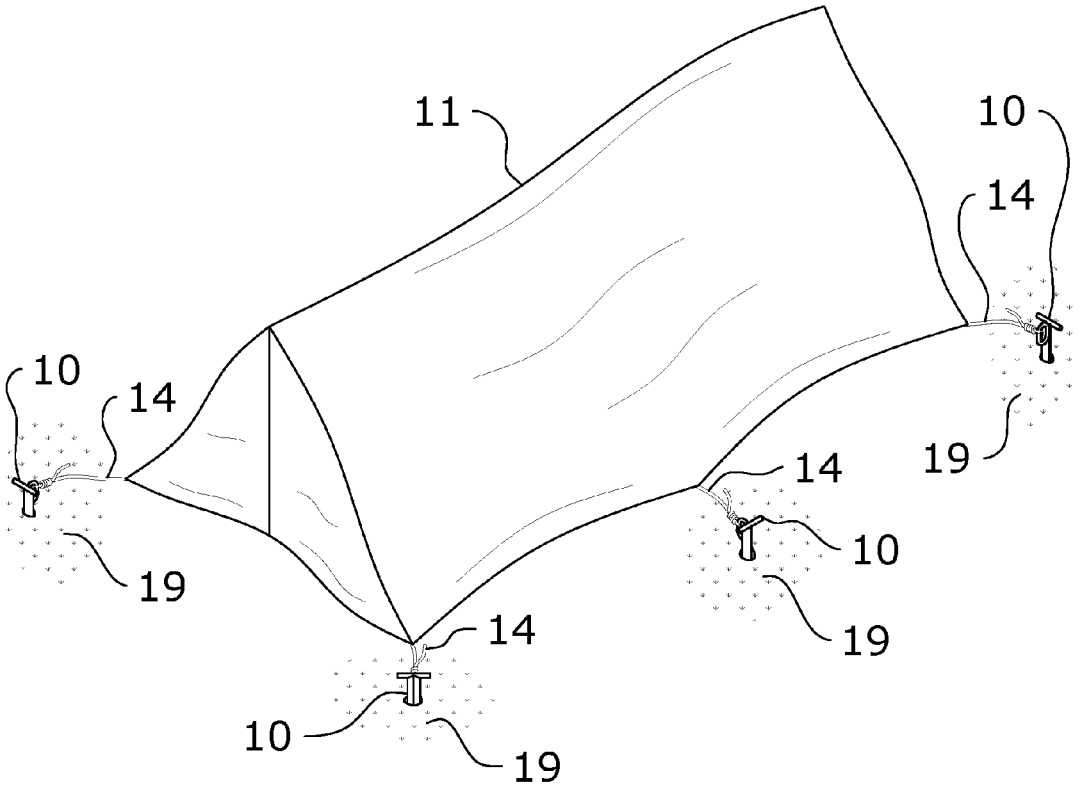
FIG. 9 is an upper perspective view illustrating a plurality of the tent stakes used to secure a tent structure.
Figure 12:
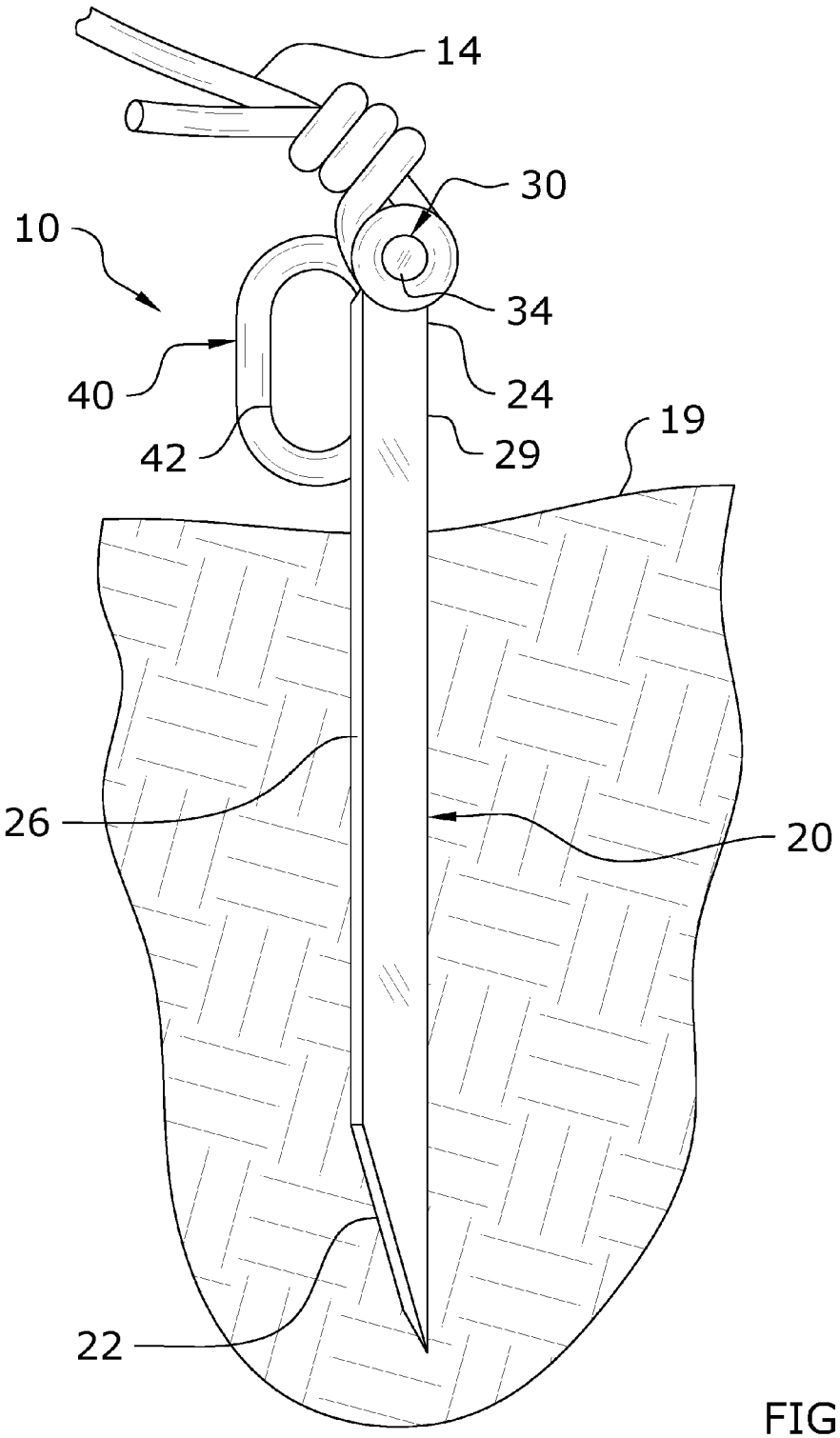
FIG. 12 is a side view illustrating a flexible connector attached to the first connector.
Figure 13:
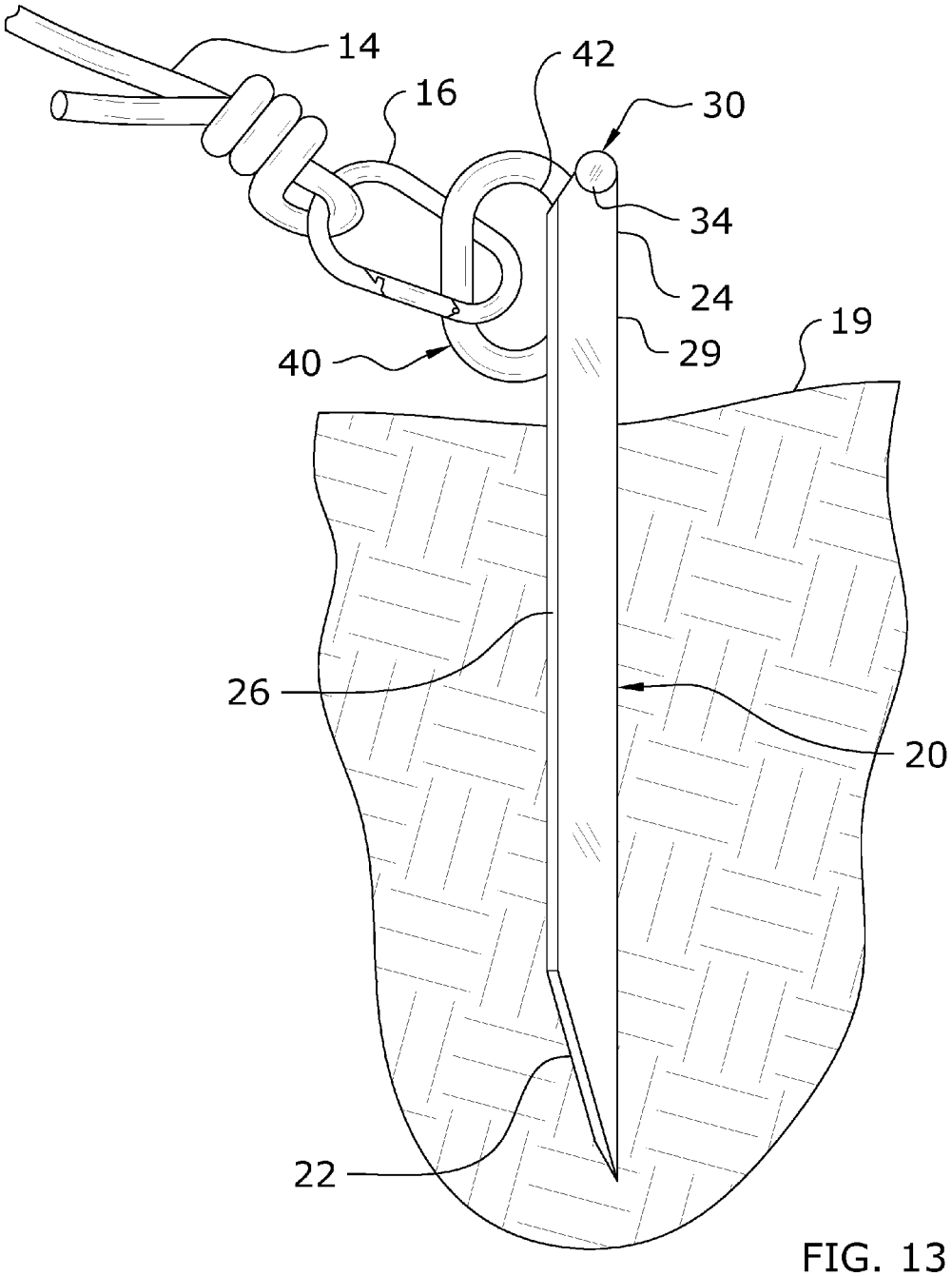
FIG. 13 is a side view illustrating a connecting link attached to the second connector.

The user then connects a flexible connector 14 (e.g. rope) to the first connector 30 and/or the second connector 40 as illustrated in FIG. 12. The opposite end of the flexible connector 14 may then be attached to a structure to be supported such as a tent structure 11 as shown in FIG. 9 of the drawings. A connecting link 16 and/or flexible connector 14 may be connected to the second connector 40 as illustrated in FIG. 13 of the drawings. It can be appreciated that one or more devices (e.g. rope, cable, carabiner) may be attached to the connectors 30, 40 simultaneously.

When finished using one of the various embodiments of the present invention, the user removes the flexible connector 14, the connecting link 16 and/or any other device attached to the tent stake 10. To loosen the tent stake 10 with respect to the ground surface 19, the user strikes the front, the rear, the left side and the right side thereof with the driving tool 12 until the shaft 20 is loosened within the ground surface 19. The user is then able to pull upwardly upon the tent stake 10 to remove the same from the ground surface 19. The user then may repeat the entire process again to secure and remove a different structure.

Unless otherwise defined, all technical and scientific terms used herein have the same meaning as commonly understood by one of ordinary skill in the art to which this invention belongs. Although methods and materials similar to or equivalent to those described herein can be used in the practice or testing of the tent stake, suitable methods and materials are described above. All publications, patent applications, patents, and other references mentioned herein are incorporated by reference in their entirety to the extent allowed by applicable law and regulations. The tent stake may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A stake, comprising:

a shaft having a lower end portion and an upper end portion opposite of the lower end portion, wherein the lower end portion is tapered, wherein the shaft is constructed of a rigid material and wherein the shaft is a substantially straight structure;

a first connector non-movably attached to the upper end portion of the shaft, wherein the first connector is comprised of an elongated structure that extends transversely with respect to the shaft, wherein the first connector is adapted for connecting to a flexible connector and for being striked by a driving tool, wherein the first connector provides a broader striking area for the driving tool and prevents damage to the shaft by distributing the striking forces throughout the upper end portion of the shaft; and a second connector non-movably attached to the upper end portion of the shaft, wherein the second connector is comprised of a loop structure having an opening, wherein the loop structure extends rearwardly from a rear inner corner of the shaft, and wherein the loop structure extends outwardly past a rear edge of the shaft;

wherein an upper end of the first connector and an upper end of the second connector are on or near a common plane to provide a striking surface for a head of the driving tool;

wherein the upper end of the first connector and the upper end of the second connector are positioned above the upper end portion of the shaft;

wherein the first connector and the second connector form a T-shaped structure when viewed from the top.

2. The stake of claim 1, wherein the lower end portion of the shaft is pointed.

3. The stake of claim 1, wherein the lower end portion is tapered to a pointed end.

4. The stake of claim 1, wherein the shaft is comprised of a metal material.

5. The stake of claim 1, wherein the shaft is comprised of angle iron.

6. The stake of claim 1, wherein the shaft is comprised of a first portion and a second portion, wherein the first portion and the second portion both extend longitudinally and have an inner angle between thereof forming a front ridge that extends longitudinally along the shaft.

7. The stake of claim 6, wherein the inner angle is approximately ninety-degrees defining the rear inner corner opposite of the front ridge.

8. The stake of claim 7, wherein the lower end portion of the shaft is tapered to a pointed end.

9. The stake of claim 1, wherein the first connector has a first extended portion extending from a first side of the shaft and a second extended portion extending from a second side of the shaft opposite of the first extended portion.

10. The stake of claim 9, wherein the first extended portion and the second extended portion have approximately the same length.

11. The stake of claim 1, wherein the first connector is attached to an upper end of the shaft.

12. The stake of claim 1, wherein the first connector is a metal shaft having a cylindrical shape.

13. The stake of claim 1, wherein the loop structure is elongated forming an elongated oval shaped opening.

14. The stake of claim 13, wherein the elongated oval shaped opening has a longitudinal axis that is parallel to a longitudinal axis of the stake.

15. The stake of claim 1, wherein a portion the opening of the second connector extends outwardly past the shaft.

16. A stake, comprising:

a shaft having a lower end portion and an upper end portion opposite of the lower end portion, wherein the lower end portion is tapered, wherein the shaft is constructed of a rigid metal material, wherein the shaft is a substantially straight structure and comprised of angle iron, and wherein the lower end portion is tapered to a pointed end;

wherein the shaft is comprised of a first portion and a second portion, wherein the first portion and the second portion both extend longitudinally and have an inner angle between thereof forming a front ridge that extends longitudinally along the shaft, wherein the inner angle is approximately ninety-degrees defining a rear inner corner opposite of the front ridge;

a first connector non-movably attached to the upper end portion of the shaft, wherein the first connector is comprised of an elongated structure that extends transversely with respect to the shaft, wherein the first connector has a first extended portion extending from a first side of the shaft and a second extended portion extending from a second side of the shaft opposite of the first extended portion, wherein the first extended portion and the second extended portion have approximately the same length, wherein the first connector is attached to an upper end of the shaft, wherein the first connector is adapted for connecting to a flexible connector and for being striked by a driving tool, wherein the first connector provides a broader striking area for the driving tool and prevents damage to the shaft by distributing the striking forces throughout the upper end portion of the shaft; and a second connector non-movably attached to the upper end portion of the shaft, wherein the second connector is comprised of a loop structure having an opening, wherein the loop structure extends rearwardly from the rear inner corner of the shaft, wherein the loop structure extends outwardly past a rear edge of the shaft;

wherein an upper end of the first connector and an upper end of the second connector are on or near a common plane to provide a striking surface for a head of the driving tool;

wherein the upper end of the first connector and the upper end of the second connector are positioned above the upper end portion of the shaft;

wherein the first connector and the second connector form a T-shaped structure when viewed from the top.

17. The stake of claim 16, wherein the first connector is a metal shaft having a cylindrical shape.

18. The stake of claim 16, wherein the loop structure is elongated forming an elongated oval shaped opening.

19. The stake of claim 18, wherein the elongated oval shaped opening has a longitudinal axis that is parallel to a longitudinal axis of the stake.

20. A stake, comprising:

a shaft having a lower end portion and an upper end portion opposite of the lower end portion, wherein the lower end portion is tapered, wherein the shaft is constructed of a rigid metal material, wherein the shaft is a substantially straight structure and comprised of angle iron, and wherein the lower end portion is tapered to a pointed end;

wherein the shaft is comprised of a first portion and a second portion, wherein the first portion and the second portion both extend longitudinally and have an inner angle between thereof forming a front ridge that extends longitudinally along the shaft, wherein the inner angle is approximately ninety-degrees defining a rear inner corner opposite of the front ridge;

a first connector non-movably attached to the upper end portion of the shaft, wherein the first connector is comprised of an elongated structure that extends transversely with respect to the shaft, wherein the first connector has a first extended portion extending from a first side of the shaft and a second extended portion extending from a second side of the shaft opposite of the first extended portion, wherein the first extended portion and the second extended portion have approximately the same length, wherein the first connector is attached to an upper end of the shaft, wherein the first connector is adapted for connecting to a flexible connector and for being striked by a driving tool, wherein the first connector provides a broader striking area for the driving tool and prevents damage to the shaft by distributing the striking forces throughout the upper end portion of the shaft; and a second connector non-movably attached to the upper end portion of the shaft, wherein the second connector is comprised of a loop structure having an opening, wherein the loop structure extends rearwardly from the rear inner corner of the shaft, wherein the loop structure extends outwardly past a rear edge of the shaft, wherein the loop structure is elongated forming an elongated oval shaped opening, wherein the elongated oval shaped opening has a longitudinal axis that is parallel to a longitudinal axis of the stake, and wherein a portion the opening of the second connector extends outwardly past the shaft;

wherein the opening of the second connector extends transversely with respect to a longitudinal axis of the shaft;

wherein an upper end of the first connector and an upper end of the second connector are on or near a common plane to provide a striking surface for a head of the driving tool;

wherein the upper end of the first connector and the upper end of the second connector are positioned above the upper end portion of the shaft;

wherein the first connector and the second connector form a T-shaped structure when viewed from the top.

* * * * *